US006266939B1

(12) United States Patent
Yates et al.

(10) Patent No.: US 6,266,939 B1
(45) Date of Patent: Jul. 31, 2001

(54) METHOD FOR CONTAINING DEBRIS

(76) Inventors: Randall E. Yates; Marguerite K. Yates, both of 2243 State Highway 83, DeFuniak Springs, FL (US) 32433

( * ) Notice: Subject to any disclaimer, the term of this patent is extended or adjusted under 35 U.S.C. 154(b) by 0 days.

(21) Appl. No.: 09/426,503

(22) Filed: Oct. 26, 1999

(51) Int. Cl.[7] ..... E04D 15/00

(52) U.S. Cl. ..... 52/741.1; 52/DIG. 12; 52/749.1

(58) Field of Search ..... 52/DIG. 12, 741.1, 52/749.1, 750

(56) References Cited

U.S. PATENT DOCUMENTS 4,576,354 * 3/1986 Blessing, Sr. ..... 52/749.1 X
4,633,899 * 1/1987 Lord ..... 52/DIG. 12 X
5,457,922 * 10/1995 Fara ..... 52/DIG. 12 X
5,617,698 * 4/1997 Guilmette ..... 52/749.1
5,685,112 * 11/1997 Fara ..... 52/DIG. 12 X

* cited by examiner

*Primary Examiner*—Peter M. Cuomo
*Assistant Examiner*—Rodney B. White
(74) *Attorney, Agent, or Firm*—Peter Loffler

(57) ABSTRACT

A method for containing debris around a cut out area uses a telescoping pole which is received within a base at one end and has a resilient receptacle attached to the other end. The base is positioned underneath the cut out area and the telescoping pole is raised until the outer periphery of the receptacle abuts the ceiling and encompasses the cut out area. The cut out procedure is performed with the receptacle capturing the debris created during the cut out procedure. A locking mechanism holds the telescoping pole in its extended position.

13 Claims, 2 Drawing Sheets

METHOD FOR CONTAINING DEBRIS

BACKGROUND OF THE INVENTION

1. Field of the Invention

The present invention relates to a method for containing debris during a cut out procedure within a ceiling of a building.

2. Background of the Prior Art

Installing grills or registers into an existing ceiling is typically a two man procedure. One man is positioned within the attic to perform the actual cut out procedure while another man is positioned underneath the area to be cut in order to capture the debris that is created during the cut off procedure. This second man holds a receptacle about the area to be cut out in order to capture the debris. Without this second man, substantial debris falls underneath the cut out area, such debris being unwelcome by the owner of the building upon which the procedure is being performed. Therefore, the second man used for capturing the debris before it enters the area underneath the cut out procedure area is an essential component of the job. Although this two man system achieves its intended purpose, it is manpower intensive and its relatively economically inefficient.

Therefore, there is a need in the art for a system that allows a single worker to perform a cut out procedure within an existing ceiling without the need for an additional worker and without creating a mess underneath the work area. Such a system must allow the worker to effectively perform the cut out procedure and must capture the resulting debris without creating a mess underneath the cut out area. Such a system must be relatively simple and straightforward to implement and must rely on relatively simple tools to achieve its intended purpose.

SUMMARY OF THE INVENTION

The method for capturing debris of the present invention addresses the aforementioned needs in the art. The method allows a single worker to perform a cut out procedure and capture the debris thereby created without making a mess underneath the cut out area. The method incorporates a tool which is of relatively simple design and which is easy to operate. The method is simple in design and implementation.

The method for containing debris around a cut out area of the present invention comprises the steps of providing a telescoping pole having a first end and a second end. Providing a base and attaching, either fixedly or removably, the first end of the telescoping pole to the base. Providing a receptacle having a closed bottom with an inset cup, and an open top having an outer periphery and attaching the second end of the telescoping pole, either fixedly or removably, threadably or otherwise, to the cup of the receptacle, and positioning the receptacle such that the outer periphery encompasses the cut out area. The receptacle has a shape that conforms to the shape of the cut out area (generally rectangular for an air conditioning grill, generally round for a light, etc). The receptacle is made from a resilient material such as plastic so that it conforms to the cut out area and provides a relatively air tight fit around the cut out area in order to prevent debris from escaping therefrom. The receptacle also applies pressure to the cut out area, reducing vibration during the cut out procedure and allowing a tighter cut. A compression fitting or any other appropriate locking mechanism can be used to lock two sections of the telescoping pole in place once the receptacle is positioned snugly against the ceiling.

BRIEF DESCRIPTION OF THE DRAWINGS

Similar reference numerals refer to similar parts throughout the several views of the drawings.

DESCRIPTION OF THE PREFERRED EMBODIMENT

Figure 1:
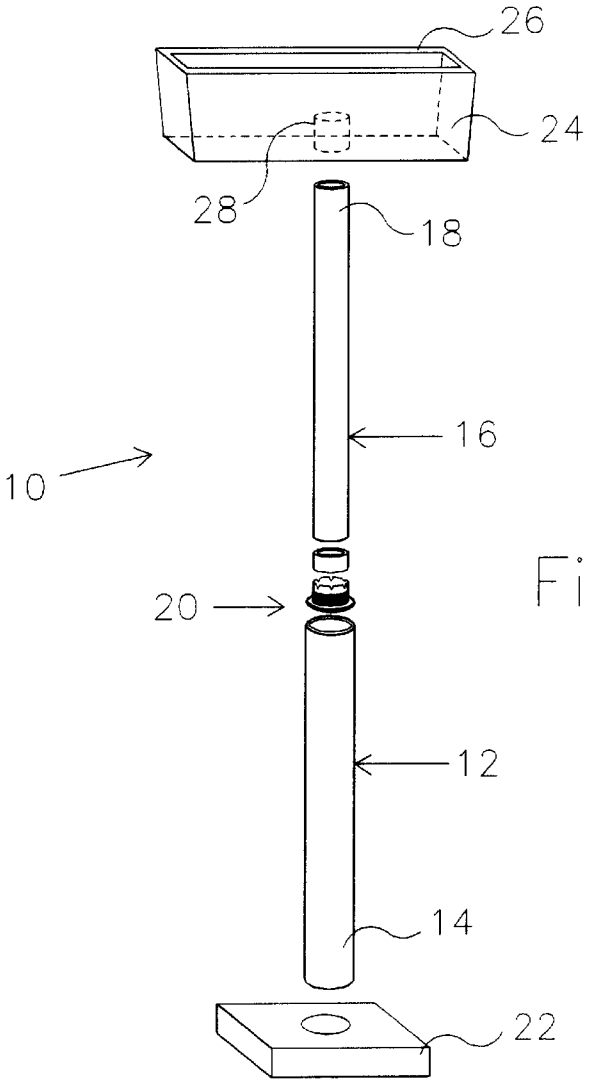
FIG. 1 is a an exploded view of the telescoping debris capturing tool used with the method for containing debris of the present invention.
Figure 2:
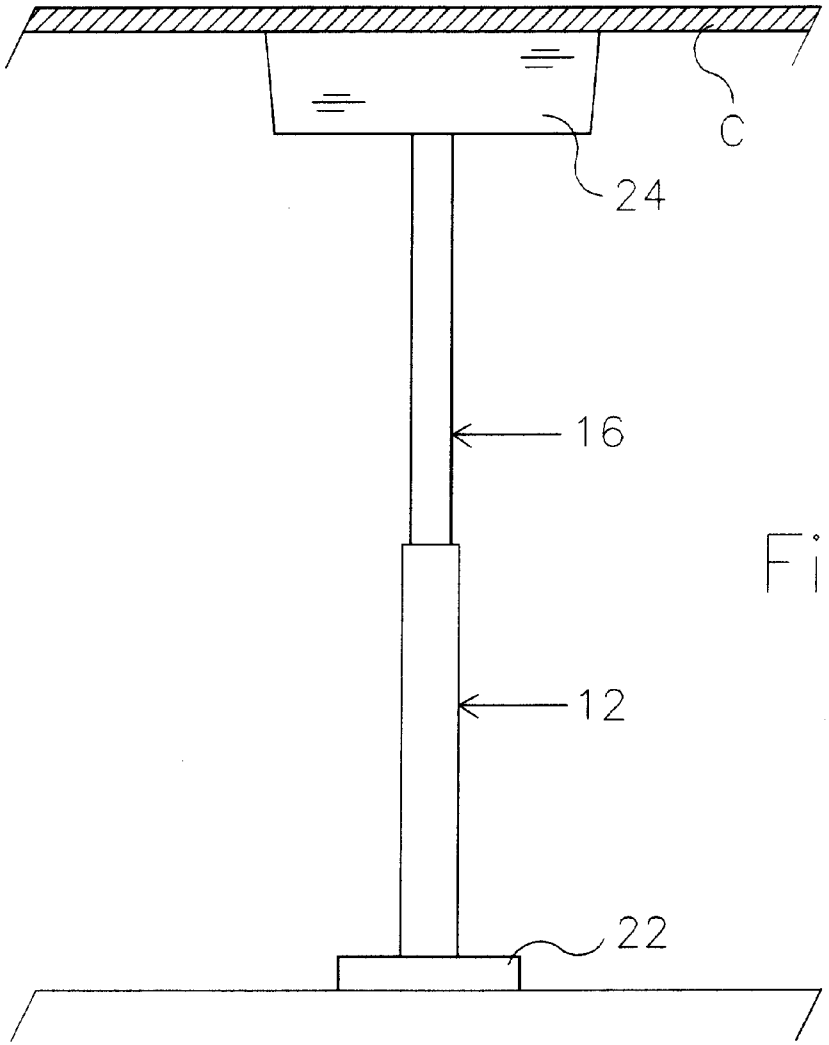
FIG. 2 is an environmental view of the debris capturing tool in position about a cut out area.

Referring now to the drawings, it is seen that the method for containing debris of the present invention comprises the steps of providing a debris containment device comprising a telescoping pole 10 having a first section 12 with a first end 14 and a second section 16 with and a second end 18. A compression fitting 20 (or any other appropriate locking mechanism) is disposed between the first section 12 and the second section 16 in order to lock the two sections 12 and 16 together whenever the telescoping pole 10 is extended to its desired length. A base 22 is provided and the first end 14 of the telescoping pole 10 is attached, either fixedly or removably, to the base 22. A receptacle 24 having a closed bottom and an open top having an outer periphery 26 is provided and is attached to the second end 18 of the telescoping pole 10, either fixedly or removably, threadably or otherwise. The second end 18 of the telescoping pole 10 being attached to a cup 28 which is inset from the bottom of the receptacle. By insetting the cup, multiple receptacles 24 can be easily stacked.

In order to perform the method for containing debris around a cut out area, the debris containment device is provided and positioned underneath the cut out area C. The telescoping pole 10 is extended such that the receptacle 24 is positioned underneath the cut out area C with the outer periphery 26 positioned snug against the ceiling and encompassing the cut out area. Once the receptacle 24 is properly positioned, the telescoping pole 10 is locked in place by the compression fitting 20 (or other appropriate locking mechanism). The receptacle 24 has a shape that conforms to the shape of the cut out area C (generally rectangular for an air conditioning grill, generally round for a light, etc). The receptacle 24 is made from a resilient material such as plastic so that it conforms to the cut out area and provides a relatively air tight fit around the cut out area C in order to prevent debris from escaping therefrom. The receptacle 24 also applies pressure to the cut out area, reducing vibration during the cut out procedure and allowing a tighter cut. Once the receptacle 24 is positioned, the cut out procedure is performed. The receptacle 24 captures the debris that is created during the cut out procedure. Once the cut out procedure is finished, the telescoping pole 10 is lowered and the receptacle 24 is removed from the cut out area C, and the debris is disposed of in appropriate fashion. The debris containment device can also be used to hold tools and other implements during building construction.

While the invention has been particularly shown and described with reference to an embodiment thereof, it will be appreciated by those skilled in the art that various changes in form and detail may be made without departing from the spirit and scope of the invention.

What is claimed is:

1. A method for containing debris around a cut out area of a ceiling comprising the steps of:

providing a telescoping pole having a first end and a second end;

providing a base;

attaching the first end of the telescoping pole to the base;

providing a receptacle having a closed bottom and an open top having an outer periphery;

removably and threadably attaching the second end of the telescoping pole to the bottom of the receptacle; and positioning the receptacle such that the outer periphery abuts the ceiling and encompasses the cut out area.

2. The method as in claim 1 wherein the receptacle has a generally rectangular shape.

3. The method as in claim 1 wherein the telescoping pole has a first section, a second section, and a compression fitting disposed between the first section and the second section for holding the first section in an extended position with respect to the second section.

4. The method as in claim 1 wherein the telescoping pole is removably attached to the base.

5. The method as in claim 1 wherein the telescoping pole is removably attached to the bottom of the receptacle.

6. The method as in claim 1 wherein the cup is inset within the receptacle.

7. The method as in claim 1 wherein the receptacle is made from a resilient material.

8. A method for containing debris around a cut out area of a ceiling comprising the steps of:

providing a telescoping pole having a first end and a second end;

providing a base;

attaching the first end of the telescoping pole to the base;

providing a receptacle having a closed bottom and an open top having an outer periphery;

attaching the second end of the telescoping pole to the bottom of the receptacle via a cup; and positioning the receptacle such that the outer periphery abuts the ceiling and encompasses the cut out area.

9. The method as in claim 8 wherein the receptacle has a generally rectangular shape.

10. The method as in claim 8 wherein the telescoping pole has a first section, a second section, and a compression fitting disposed between the first section and the second section for holding the first section in an extended position with respect to the second section.

11. The method as in claim 8 wherein the telescoping pole is removably attached to the base.

12. The method as in claim 8 wherein the cup is inset within the receptacle.

13. The method as in claim 8 wherein the receptacle is made from a resilient material.

* * * * *